US008948441B2

(12) United States Patent
Zhao

(10) Patent No.: US 8,948,441 B2
(45) Date of Patent: Feb. 3, 2015

(54) PLANAR SPEAKER SYSTEM

(75) Inventor: Zhijun Zhao, West Bloomfield, MI (US)

(73) Assignee: Harman International Industries, Inc., Northridge, CA (US)

( * ) Notice: Subject to any disclaimer, the term of this patent is extended or adjusted under 35 U.S.C. 154(b) by 73 days.

(21) Appl. No.: 13/419,858

(22) Filed: Mar. 14, 2012

(65) Prior Publication Data

US 2013/0243238 A1 Sep. 19, 2013

(51) Int. Cl.
*H04R 1/00* (2006.01)

(52) U.S. Cl.
USPC ..... 381/430; 381/400; 381/398

(58) Field of Classification Search
USPC ..... 381/431, 398, 400
See application file for complete search history.

(56) References Cited

U.S. PATENT DOCUMENTS

| | | | |
|---|---|---|---|
| 3,272,956 | A | 9/1966 | Baermann |
| 4,480,155 | A | 10/1984 | Winey |
| 4,544,805 | A | 10/1985 | Sawafuji |
| 4,590,332 | A | 5/1986 | Delbuck |
| 4,703,510 | A | 10/1987 | Larson |
| 4,803,733 | A | 2/1989 | Carver et al. |
| 4,837,838 | A | 6/1989 | Thigpen et al. |
| 4,924,504 | A | 5/1990 | Burton |
| 4,939,784 | A | 7/1990 | Bruney |
| 5,021,613 | A | 6/1991 | Garcia |
| 5,148,493 | A | 9/1992 | Bruney |
| 5,283,836 | A | 2/1994 | Trufitt |
| 5,701,358 | A | 12/1997 | Larsen et al. |
| 6,047,077 | A | 4/2000 | Larsen |
| 6,104,825 | A | 8/2000 | Thigpen |
| 6,449,376 | B1 | 9/2002 | Beltran et al. |
| 6,480,614 | B1 | 11/2002 | Denda et al. |
| 6,841,702 | B2 | 1/2005 | Magdolen et al. |
| 6,845,166 | B2 | 1/2005 | Hara et al. |
| 6,917,270 | B1 | 7/2005 | Kyouno et al. |
| 7,286,681 | B2 | 10/2007 | Gerkinsmeyer |
| 7,627,134 | B2 | 12/2009 | Garner et al. |
| 7,940,952 | B2 | 5/2011 | Regl |
| 7,940,953 | B2 | 5/2011 | Regl et al. |

(Continued)

FOREIGN PATENT DOCUMENTS

| | | | |
|---|---|---|---|
| CN | 102056056 | A | 5/2011 |
| EP | 1 194 001 | A1 | 4/2002 |

(Continued)

OTHER PUBLICATIONS

Extended European Search Report dated Jun. 11, 2013.

(Continued)

*Primary Examiner* — Duc Nguyen
*Assistant Examiner* — Phan Le
(74) *Attorney, Agent, or Firm* — Brooks Kushman P.C.

(57) ABSTRACT

A planar speaker system may include a bottom frame having a cavity. Within this cavity a plurality of magnets may be arranged to form a substantially circular pattern. A diaphragm that includes a plurality of electrically conductive traces may be connected to the bottom frame and extend across the cavity of the bottom frame. When alternating current flows through the electrically conductive traces, the diaphragm may vibrate in response to the interaction between the current flowing in the electrically conductive traces and the magnetic field, thereby producing sound. The planar speaker system may include a top frame having a cavity, and a second set of magnets may be disposed in the cavity of the top frame.

11 Claims, 10 Drawing Sheets

(56) References Cited

U.S. PATENT DOCUMENTS

| | | | | |
|---|---|---|---|---|
| 8,378,777 | B2 | 2/2013 | Yan et al. | |
| 2001/0048256 | A1 | 12/2001 | Miyazaki et al. | |
| 2002/0191808 | A1 | 12/2002 | Croft, III et al. | |
| 2003/0133581 | A1 | 7/2003 | Klayman | |
| 2004/0013282 | A1 | 1/2004 | Coffin | |
| 2004/0202347 | A1* | 10/2004 | Koike | 381/431 |
| 2005/0220320 | A1 | 10/2005 | Kim et al. | |
| 2006/0023902 | A1 | 2/2006 | Thigpen | |
| 2007/0127767 | A1* | 6/2007 | Croft et al. | 381/422 |
| 2008/0205688 | A1* | 8/2008 | Sato | 381/400 |
| 2008/0219469 | A1 | 9/2008 | Simidian et al. | |
| 2010/0278371 | A1* | 11/2010 | Hanada | 381/398 |
| 2011/0085692 | A1 | 4/2011 | Voishvillo | |
| 2012/0087518 | A1 | 4/2012 | Simidian, II et al. | |

FOREIGN PATENT DOCUMENTS

| | | | |
|---|---|---|---|
| EP | 1367854 | A1 | 12/2003 |
| EP | 1731643 | A1 | 12/2006 |
| EP | 1267854 | B1 | 11/2007 |
| EP | 1731643 | B1 | 2/2011 |
| WO | WO01/70204 | A2 | 9/2001 |
| WO | 2005055647 | A1 | 6/2005 |
| WO | WO 2011/142030 | A1 | 11/2011 |

OTHER PUBLICATIONS

WO01/70204 A3 with International Search Report dated Feb. 12, 2002.

United States Patent and Trademark Office, Office Action for U.S. Appl. No. 13/419,874 mailed May 2, 2014.

Patent and Trademark Office, Non-final Office Action for U.S. Appl. No. 13/419,874 mailed Mar. 28, 2013.

Patent and Trademark Office, Final Office Action for U.S. Appl. No. 13/419,874 mailed Oct. 11, 2013.

European Patent Office, Extended Search Report for European Patent Application No. 13158816.2 mailed Jun. 7, 2013.

* cited by examiner

PLANAR SPEAKER SYSTEM

BACKGROUND OF THE INVENTION

1. Technical Field

The invention generally relates loudspeakers for use in audio systems, and more particularly to planar speaker systems.

2. Related Art

The general construction of an electro-dynamic speakers, sometimes referred to as a planar speakers, includes a diaphragm in the form of a thin film attached intention to a frame. An electrical circuit, in the form of electrically conductive traces, is applied to the surface of the diaphragm. Magnetic sources, typically in the form of permanent magnets, are mounted adjacent to the diaphragm or within the frame, creating a magnetic field. When current is flowing in the electrical circuit, the diaphragm vibrates in response to the interaction between the current and the magnetic field. The vibration of the diaphragm produces the sound generated by the planar speaker.

SUMMARY

A planar speaker system may include a bottom frame having a cavity. Within this cavity is a plurality of magnets arranged to form a substantially circular pattern. A diaphragm, having a plurality of electrically conductive traces formed is connected to the bottom frame and extends across the cavity of the bottom frame. When current flows through the electrically conductive traces, the diaphragm vibrates in response to the interaction between the current and the magnetic field, thereby producing sound.

In another example, the diaphragm and bottom frame both have an inner diameter. A pole piece connects the inner diameter of the bottom frame and the inner diameter of the diaphragm. Generally, the pole piece is located such that the plurality of magnets are arranged around the pole piece in a substantially circular pattern.

In yet another example, the planar speaker system and any of the examples described above may also include a top frame connected to the bottom frame, such that the plurality of magnets are located between the bottom frame and the top frame. By so doing, the top frame can act as an aperture for guiding sound generated by the planar speaker system.

In still yet another embodiment, the planar speaker system may include both a top frame and a bottom frame, the top frame defines a first cavity and the bottom frame defines a second cavity. A first set of magnets is disposed in the first cavity and arranged in a substantially circular pattern. In like manner, a second set of magnets is disposed in the second cavity and arranged in a substantially circular pattern. The diaphragm is located between the first and second set of magnets and has electrically conductive traces formed which, as explained earlier, vibrates due to the interaction between the current applied thereto and the magnetic fields generated by both sets of magnets.

Further objects, features and advantages of this invention will become readily apparent to persons skilled in the art after a review of the following description, with reference to the drawings and claims that are appended to and form a part of this specification.

Other systems, methods, features and advantages will be, or will become, apparent to one with skill in the art upon examination of the following figures and detailed description. It is intended that all such additional systems, methods, features and advantages be included within this description, be within the scope of the invention, and be protected by the following claims.

BRIEF DESCRIPTION OF THE DRAWINGS

The system may be better understood with reference to the following drawings and description. The components in the figures are not necessarily to scale, emphasis instead being placed upon illustrating the principles of the invention. Moreover, in the figures, like referenced numerals designate corresponding parts throughout the different views.

DETAILED DESCRIPTION OF THE PREFERRED EMBODIMENTS

Often, space limitations in the listening environment prohibit the use of a loudspeaker in an audio system that possesses the preferred directivity pattern for the system's design. For example, the amount of space and the particular locations available in a listening environment for locating and/or mounting the loudspeakers of the audio system may prohibit the use of a particular loudspeaker that exhibits the intended directivity pattern. Also, due to space and location constraints, it may not be possible to position or oriented the desired loudspeaker in a manner consistent with the loudspeaker's directivity pattern. Consequently, size and space constraints of a particular environment may make it difficult to achieve the desired performance from the audio system. An example of a listening environment having such constraints is the interior passenger compartment of an automobile or other vehicle.

While the electric circuitry of electro-dynamic speakers may present design challenges, electro-dynamic loudspeakers are very desirable loudspeakers because they are designed to have a very shallow depth. With this dimensional flexibility, electro-dynamic loudspeakers may be positioned at locations where conventional loudspeakers would not traditionally fit. This dimensional flexibility is particularly advantageous in automotive applications where positioning a loudspeaker at a location that a conventional loudspeaker would not otherwise fit could offer various advantages. Further, because the final loudspeaker assembly may be mounted on a vehicle, it is important that the assembly be rigid during shipping and handling so that the diaphragm or frame does not deform during installation.

While conventional electro-dynamic loudspeakers are shallow in depth and may therefore be preferred over conventional loudspeakers for use in environments requiring thin loudspeakers, electro-dynamic loudspeakers have a generally rectangular planar radiator that is generally relatively large in height and width to achieve acceptable operating wavelength sensitivity, power handling, maximum sound pressure level capability and low-frequency bandwidth, limiting their applications.

Figure 1:
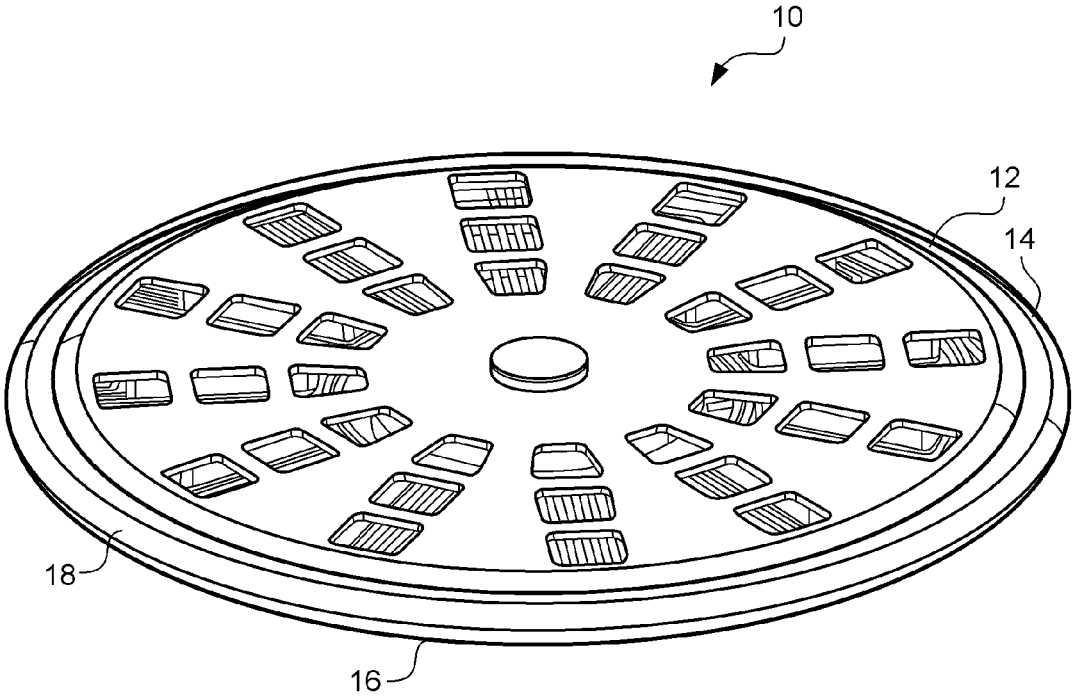
FIG. 1 illustrates an example of a planar speaker system having a plurality of magnets disposed in a frame in a substantially circular pattern.

In FIG. 1, an example of a planar speaker system 10 is shown. The planar speaker system 10 generally includes a top frame 12 having an outer diameter 14 and a bottom frame 16 also having an outer diameter 18. The outer diameter 14 of the top frame 12 is connected to the outer diameter 18 of the bottom frame 16. Generally, the frames 12 and 16 are made of steel, but may be made of any suitable material, such as other metals and plastics.

Figure 2:
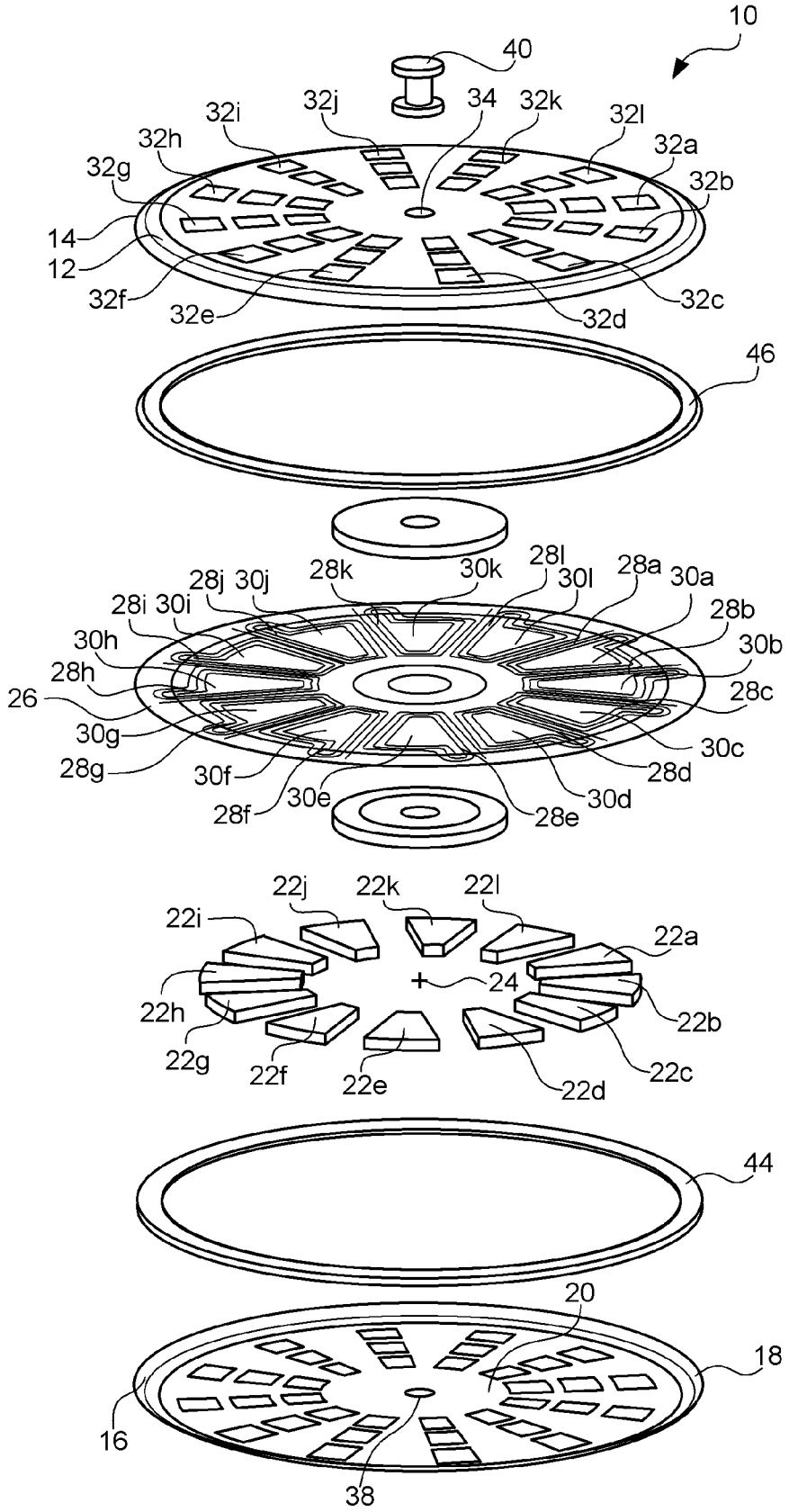
FIG. 2 is an exploded view of the planar speaker system of FIG. 1.

FIG. 2 is an exploded view of the planar speaker system 10 of FIG. 1. As stated previously, the planar speaker system 10 includes a top frame 12 having an outer diameter 14 and a bottom frame 16 having an outer diameter 18. The bottom frame 16 defines a cavity 20. The cavity 20 may be circular in shape. Located within the cavity 20 of the bottom frame 16 are magnets 22*a*-22*l*. The magnets are generally arranged in a circular pattern about a central axis 24. In this embodiment there are twelve magnets 22*a*-22*l*, but any suitable number of magnets may be utilized.

Each of the plurality of magnets 22*a*-22*l* can each take a variety of different shapes such as a substantially trapezoidal shape, a substantially semi-circular shape, or a substantially triangular shape. The plurality of magnets 22*a*-22*l* may be either ferrite magnets or rare-earth magnets, or any other magnetic material.

Located above the plurality of magnets 22 is a diaphragm 26. The diaphragm 26 includes a group of electrically conductive traces 28*a*-28*l*. The electrically conductive traces 28*a*-28*l* may be formed in the diaphragm 26, or may be coupled to a surface of the diaphragm 26. In this embodiment, there are twelve electrically conductive traces 28*a*-28*l* that correspond to the twelve magnets 22*a*-22*l*. The diaphragm 26 is connected to the outer diameter 18 of the bottom frame 16 and extends across the cavity 20 of the bottom frame 16. The plurality of magnets 22*a*-22*l* may be enclosed between the diaphragm 26 and the bottom frame 16 in the cavity 20.

Each of the electrically conductive traces 28*a*-28*l* are routed in/on the diaphragm in a predetermined shape to represent a coil having a central region where there are no electrically conductive traces. In one example, the each of the electrically conductive traces 28*a*-28*l* may be routed to form a triangular shaped coil having a generally triangular middle section 30*a*-30*l* around which each respective trace is routed. As shown, there are four turns to each of the traces 28*a*-28*l*, however, any number of turns of the traces may be utilized. When a time-varying current is applied to the electrically conductive traces 28*a*-28*l*, due to the coil configuration, an electromagnetic field is created by the electrically conductive traces 28*a*-28*l*. The interaction of the electromagnetic field induced by the time varying current in the electrically conductive traces 28*a*-28*l* with the magnetic field produced by the magnets 22*a*-22*l* may cause the diaphragm 26 to vibrate, thereby producing a sound. Thus, time-varying current representative of music or a human voice can be applied to the electrically conductive traces 28*a*-28*l* to generate the music or human voice as audible sound.

The top frame 12 may have a plurality of openings 32*a*-32*l*. The openings 32*a*-32*l* can direct the sound generated by the diaphragm 26 and the electrical traces 28*a*-28*l* have a current applied. The openings 32*a*-32*l* can vary in both number and in shape. The purpose of these openings 32*a*-32*l* may include guiding sound waves generated when the diaphragm 26 vibrates.

The top frame 12 may further include an inner diameter 34. In like manner, the diaphragm 26 may include an inner diameter 36 and the bottom frame 16 may also include an inner diameter 38. A pole piece 40 may be connected to the inner diameters 34, 36, and 38 of the top frame 14, diaphragm 26, and bottom frame 16 respectively. A fastener, such as a screw 42 may extend within the inner diameters 34, 36, and 38 of the top frame 12, diaphragm 26, respectively, and engage the cone 40 thereby holding the pole piece 40 in place and in connection with the top frame 12, diaphragm 26, and bottom frame 16. In other examples, other forms of fastener, an adhesive, or any other retention device may be used.

Figure 3:
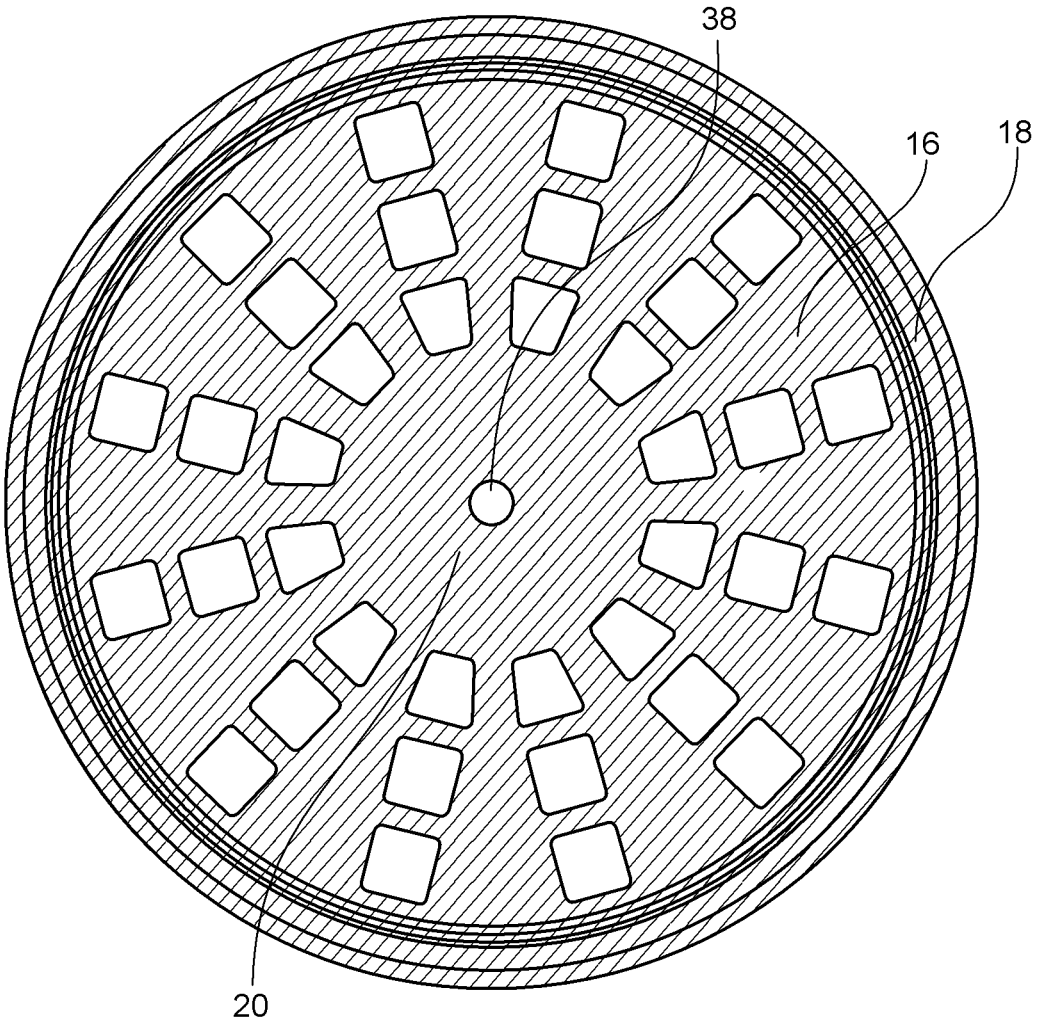
FIG. 3 illustrates a bottom frame of the planar speaker system of FIG. 1.

FIG. 3 is a more detailed view of an example of the bottom frame 16. As stated previously, the bottom frame 16 includes an outer diameter 18 and an inner diameter 38. The bottom frame 16 may be shaped such that the cavity 20 is defined. Generally, the cavity 20 may be circular in shape as is the outer diameter 18 of the bottom frame 16.

Figure 4:
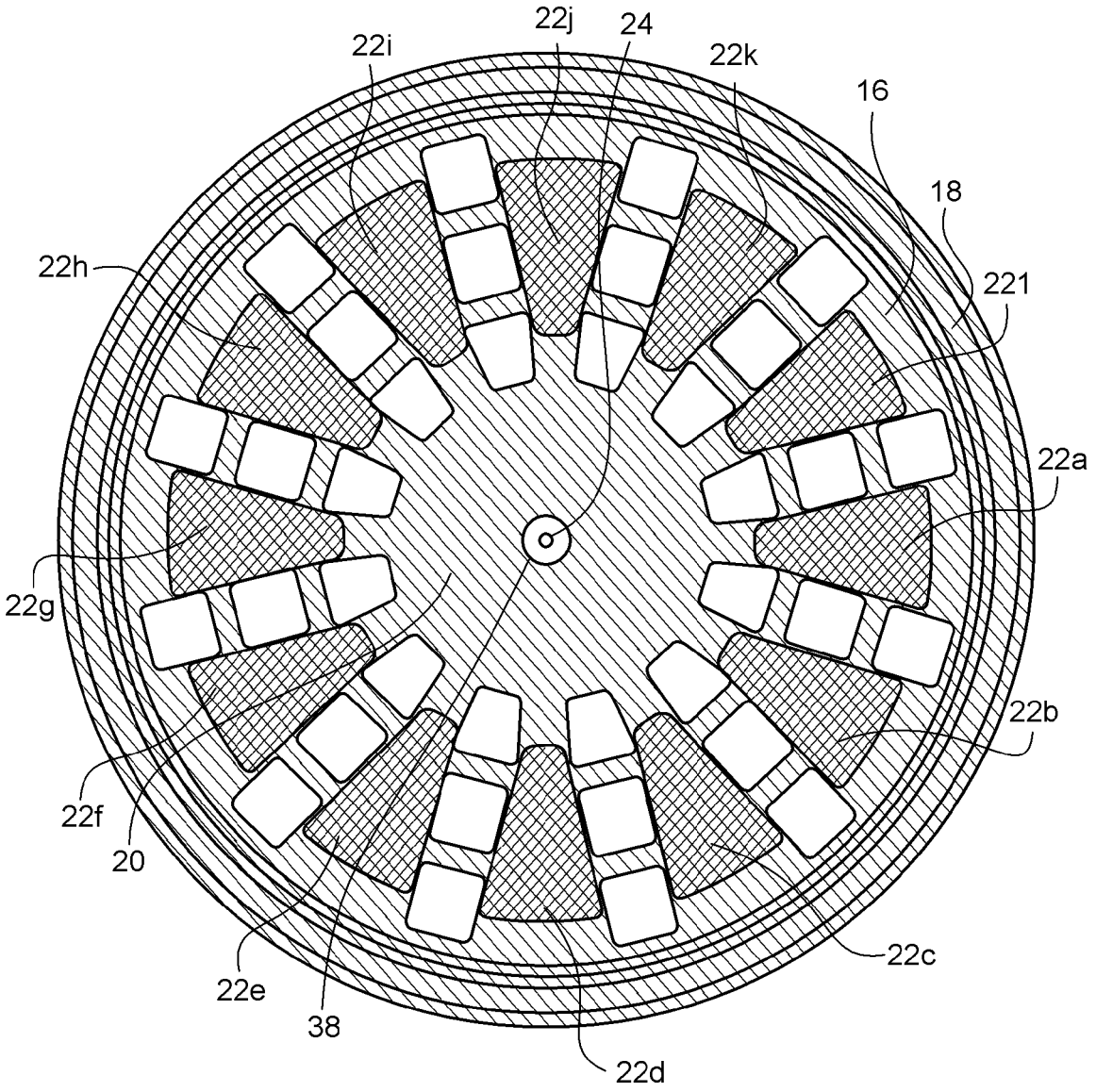
FIG. 4 illustrates an example of a set of magnets arranged in a circular pattern within the bottom frame of FIG. 3.

FIG. 4 is an example of the bottom frame 16 that includes magnets 22*a*-22*l* disposed within the cavity 20 defined by the bottom frame 16. The magnets 22*a*-22*l* are arranged in a circular pattern about a central axis 24. The magnets 22*a*-22*l* may take any of a variety of different shapes suitable for the application. In some examples, the magnets 22*a*-22*l* may be rectangular, trapezoidal, or semi-circular in shape.

Figure 5:
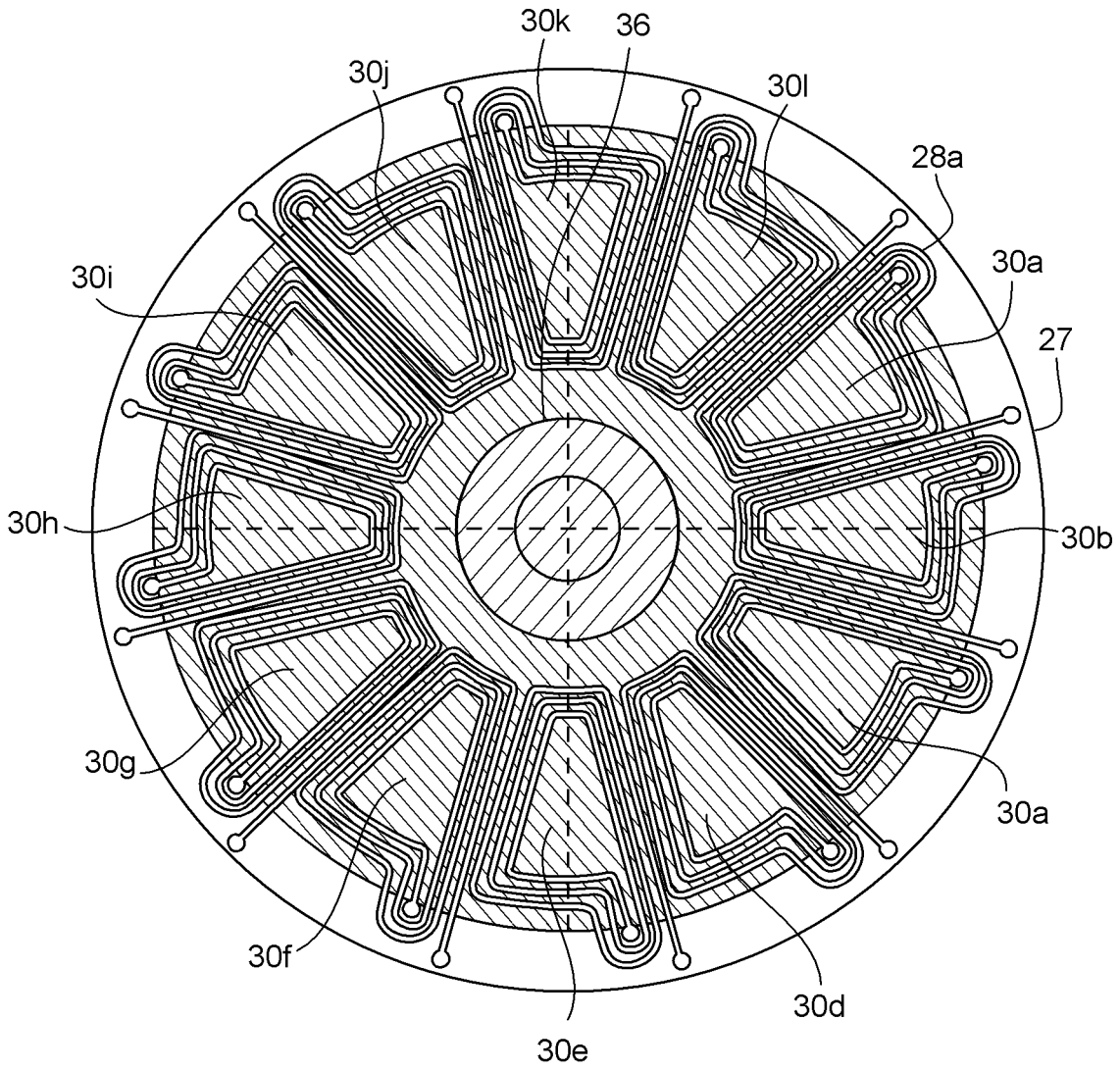
FIG. 5 illustrates an example of a diaphragm having conductive traces placed thereon.

FIG. 5, a more detailed view of an example of the diaphragm 26. As stated previously, diaphragm 26 includes an inner diameter 36 and an outer diameter 27. The diaphragm 26 may be substantially circular in shape. The diaphragm 26 may be formed with a flexible substantially planar sheet material, such as a thin film, that may be attached, in tension, to the bottom frame 16. Typically, the diaphragm 26 is constructed of a pre-expanded cellular plastic material, such as polystyrene or polyimide. The frequency response of a diaphragm 26 generally is determined by the type and density of its material, and the area, thickness and contour of its sound producing region. A predetermined tension may be used to optimize the resonance frequency of the diaphragm. Optimizing diaphragm resonance may extend the bandwidth and reduce sound distortion of the speaker.

Placed on the diaphragm 26 are conductive traces 28*a*-28*l*. Each of the conductive traces 28*a*-28*l* generally defines an area 30*a*-30*l* that does not have any conductive traces. In one example, the areas 30*a*-30*l* that do not have conductive traces 30*a*-30*l* are generally rectangular and/or trapezoidal in shape. The conductive traces 28*a*-28*l* may be made of aluminum. Each of the conductive traces 28*a*-28*l* has first terminals 29*a*-29*l* and second terminal 31*a*-31*l*. A voltage is applied across the first terminals 29*a*-29*l* and second terminal 31*a*-31*l*, so as to provide a current thought the conductive traces 28*a*-28*l*.

Figure 6:
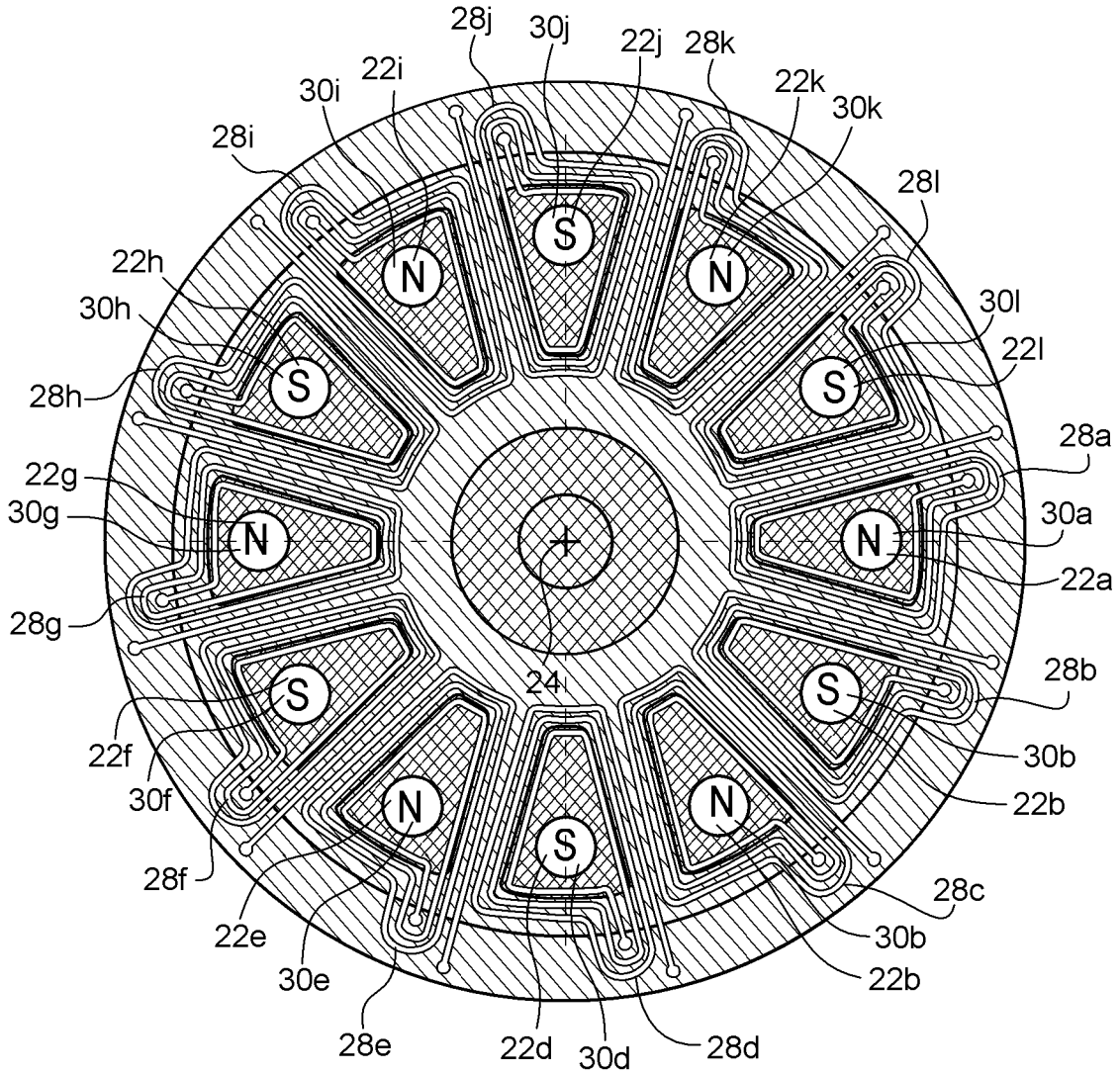
FIG. 6 illustrates an example of a frame, magnets, and a diaphragm of a planar speaker system.

In FIG. 6, a more detailed view of an example of the diaphragm 26 having the conductive traces 28*a*-28*l* as well as the first set of the plurality of magnets 22*a*-22*l* is shown. Generally, the magnets 22*a*-22*l* are placed adjacent to the diaphragm such that the magnets 22*a*-22*l* have borders that generally define the open space 30*a*-30*l* and are aligned with of each of the respective conductive traces 28*a*-28*l*. The traces 28*a*-28*l* are around the outside edge of magnets, 22*a*-22*l* but the inner circle of trace may overlap with edge of a magnet due to the strong magnetic flux intensity field. Each of the magnets 22*a*-22*l* may be aligned to have a polarity (north(N) or south(S)) facing the diaphragm 26 that is opposite an adjacently positioned magnet. Thus, a magnet has a reversed polarity when compared to the magnets positioned on either side. During operation, the alternating polarity of the magnets around the diaphragm 26 causes opposing attraction and repulsion of the traces by adjacently positioned magnets.

Figure 7:
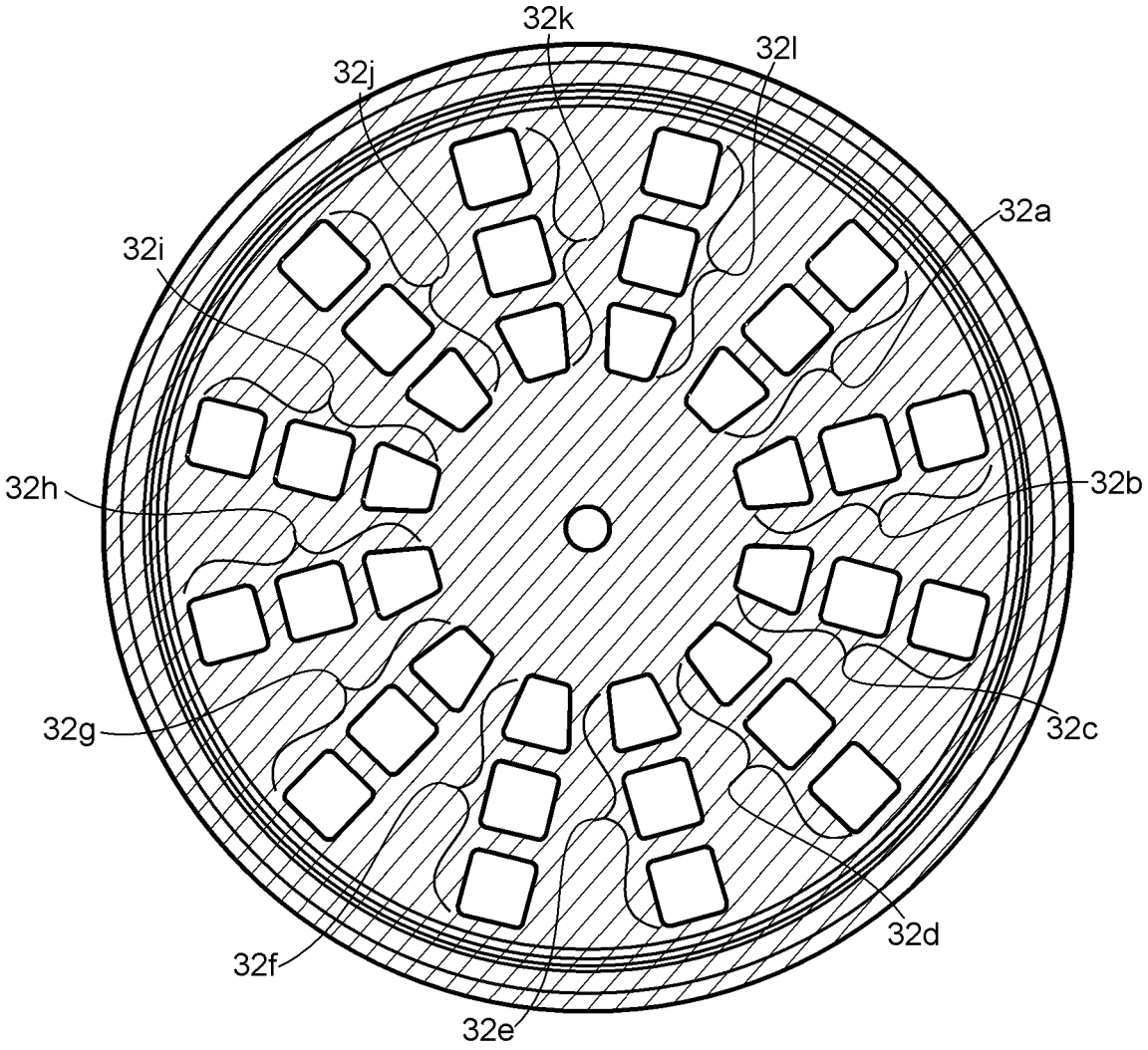
FIG. 7 illustrates a top frame of the planar speaker system of FIG. 6.

FIG. 7 is a more detailed view of an example of the top frame 12. The top frame 12 has a plurality of openings 32*a*-32*l*. The number of openings 32*a*-32*l* may vary significantly based on the application. As such, the openings 32*a*-32*l* may include fewer or more openings based on a variety of different shapes that are formed and configured to transmit sounds generated by the planar speaker system. In FIG. 7, the openings 32*a*-32*l* are formed to be axially aligned with the inner diameter 34 of the top frame 12 and to be substantially evenly spaced. The openings 32*a*-32*l* may be formed in a predetermined shape, such as a tapered shape such that each of the openings 32*a*-32*l* become increasingly larger with distance from the inner diameter 34. In some examples, the openings 32*a*-32*l* may be formed to cooperatively operate as a waveguide or lens to provide directivity, dispersion, or any other effect on the sound waves emitted by the planar speaker system. The top frame 12 may also include passageways to eliminate restrictive airflow in front of the diaphragm.

Figure 8:
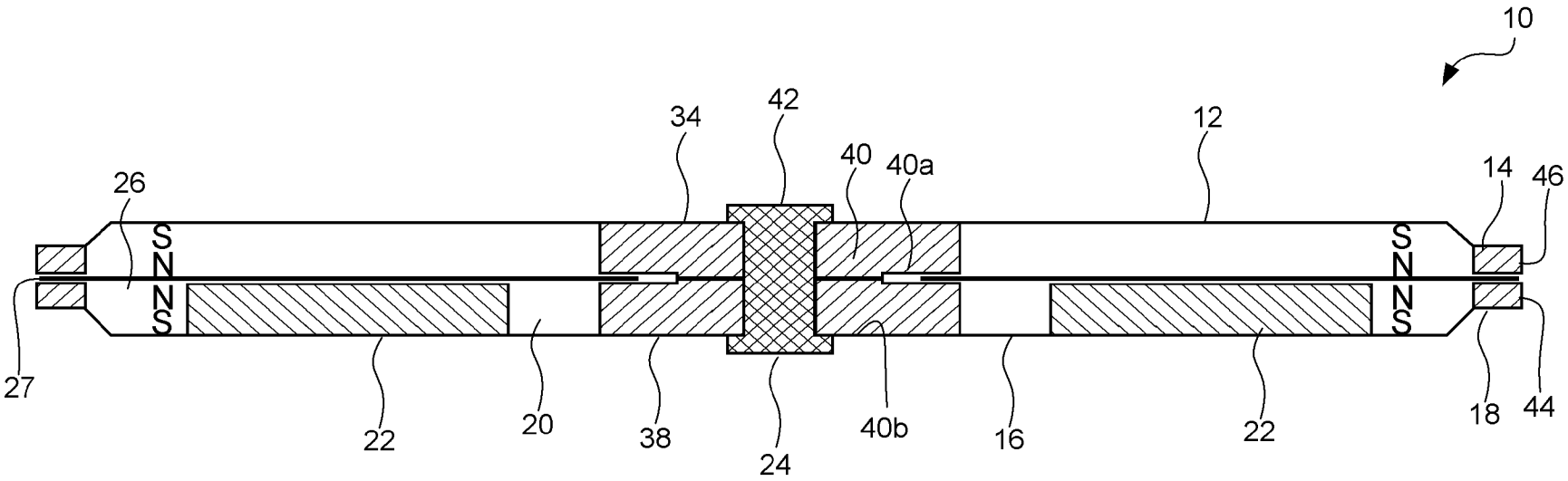
FIG. 8 illustrates a cutaway view of the planar speaker system of FIG. 1.

FIG. 8 is a cutaway view of an example of the planar speaker system 10 of FIG. 1. As stated previously, the planar speaker system may include both a top frame 12 having an outer diameter 14 and a bottom frame 16 having an outer diameter 18. The bottom frame 16 may define a cavity 20, and within the cavity 20 magnets 22*a*-22*l* may be arranged in a substantially circular formation about a central axis 24. The top and bottom frames each include outer diameters 14 and 18 respectively.

Additionally, the diaphragm 26 may be a predetermined shape, such as a circular diaphragm, that has an outer diameter 27 and an inner diameter 36. In this example, there is also a first circular ring 44 and a second circular ring 46. The first circular ring 44 is connected to the outer diameter 18 of the bottom frame 16, while the second circular ring 46 is connected to the outer diameter 14 of the top frame 12. The outer diameter of the diaphragm may be sandwiched between the first ring 44 and the second ring 46 to fixedly maintain the position of the diaphragm 27 with respect to the magnets 22.

Figure 9:
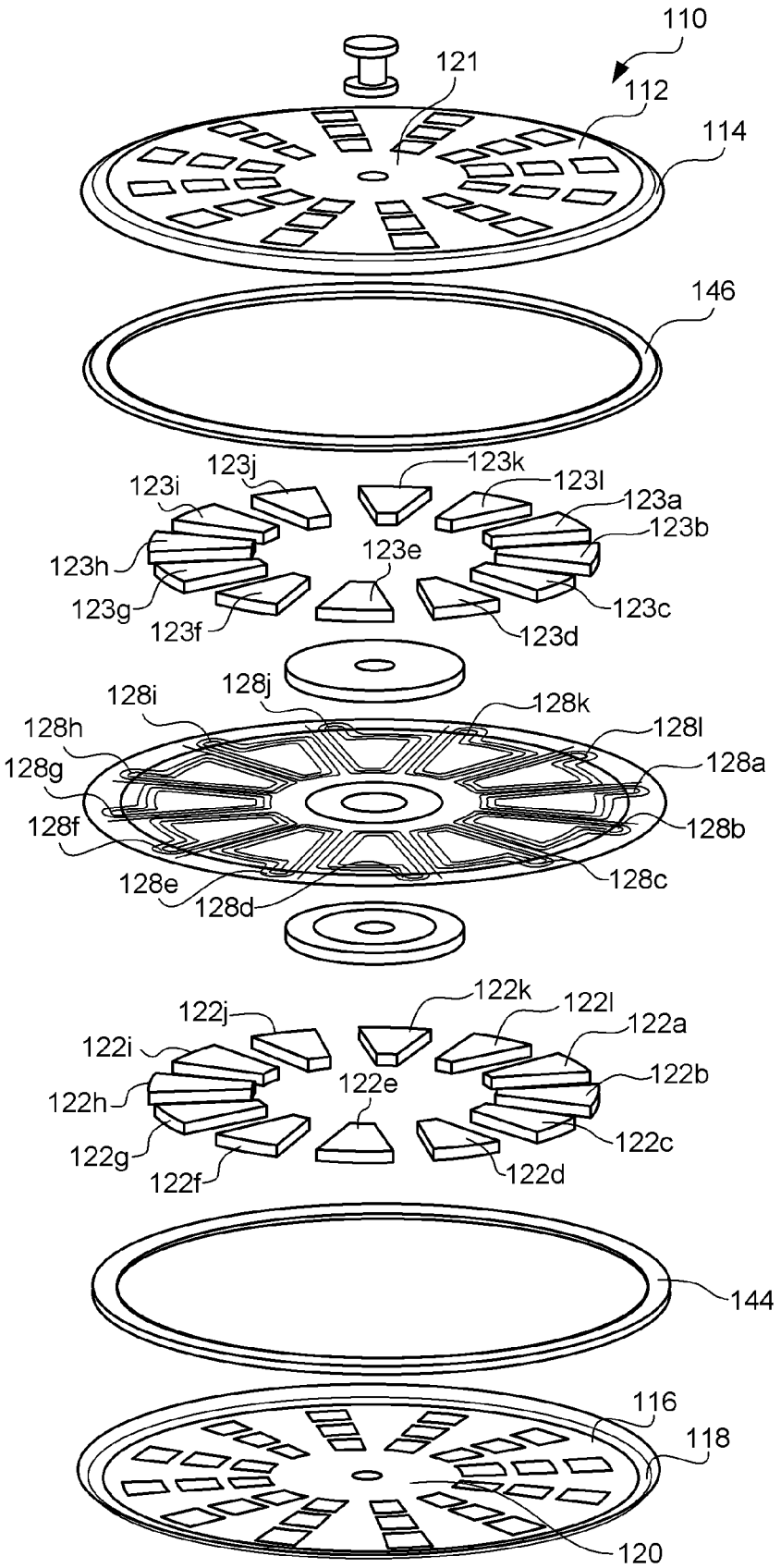
FIG. 9 illustrates an exploded view of another embodiment of a planar speaker system having a first and second set of magnets arranged in a circular pattern.

Further, the pole piece 40 has a top section 40*a* and a bottom section 40*b*, with a fastener, such as a screw holding the pole piece sections together. The outer diameter of the pole piece 40 may be connected to the inner diameter 36 of the diaphragm. The fastener may connect the portions 40*a* and 40*b* of the pole piece 40 such that the inner diameter 36 of the diaphragm 26 is connected to the pole piece 40. FIG. 9 is another example of the speaker system 110. In this embodiment, similar reference numerals will be used to refer to similar items, with the difference that numerals will be incremented by 100. Like before, this embodiment may include a top frame 112 and a bottom frame 116. In this example, the speaker system 110 is substantially circular, in other examples, the speaker system 110 may be formed in other shapes, such as an ellipse. In FIG. 9, the top frame 112 has an outer diameter 114, while the bottom frame 116 has an outer diameter of 118. Like before, the bottom frame 116 may define a cavity 120. However, the top frame 112 may also define a top cavity 121.

Magnets 122 may be disposed within the cavity 120 of the bottom frame 116 in a circular pattern. Additionally, a diaphragm 126 may be connected to the outer diameter 118 of the bottom frame 116 or the outer diameter 114 of the top frame 112. The diaphragm 126 may include electrically conductive traces 128*a*-128*l*. These electrically conductive traces 128*a*-128*l* are similar to those previously described regarding electrically conductive traces 28*a*-28*l*, in the paragraphs and figures above. The speaker system 110 also includes magnets 123 disposed in the cavity 121 in a circular fashion about a central axis. The upper magnets may be lined up exactly like a mirror 3-D image of bottom magnet matrix based on the diaphragm, the bottom polarity of upper magnet should be the same polarity as the top of bottom magnet.

Figure 10:
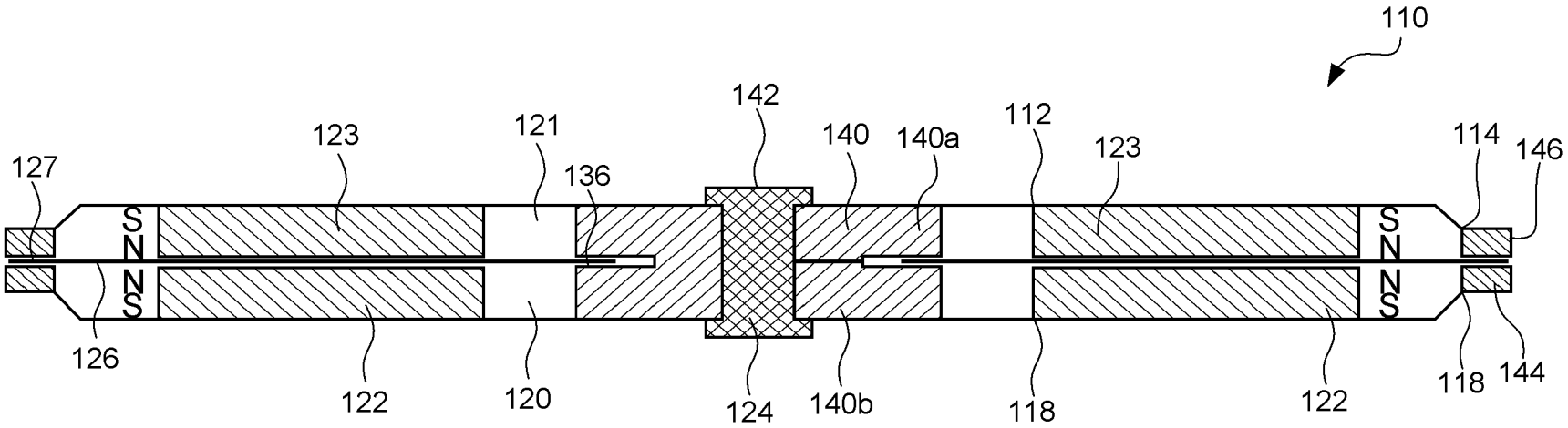
FIG. 10 illustrates a cutaway view of the planar speaker system of FIG. 9.

FIG. 10 is a cutaway view of the speaker system 110 of FIG. 9. Here, the speaker system 110 includes the top frame 112 having an outer diameter 114 and a bottom frame having an outer diameter 118. The top frame 112 defines a cavity 121 while the bottom frame 116 defines a cavity 120. Located within the cavity 121 is the plurality of magnets 123*a*-123*l*. In like manner, located within the bottom cavity 120 is a plurality of magnets 122*a*-122*l*. As mentioned before, the magnets 122*a*-122*l* are arranged in a circular pattern about a central axis 124. The speaker system 110 may also include annular ring 144 connected to outer diameter 118 and annular ring 146 connected to outer diameter 114. The diaphragm 126 has an outer diameter 127 connected to the annular rings 144 and 146. Further, the annular ring 126 also has an outer diameter 136 connected to a pole piece 140 that may have a top portion 140*a* and a bottom portion 140*b*. Connecting the two portions 140*a* and 140*b* of the pole piece 140 is a fastener 142

While various embodiments of the invention have been described, it will be apparent to those of ordinary skill in the art that many more embodiments and implementations are possible within the scope of the invention. Accordingly, the invention is not to be restricted except in light of the attached claims and their equivalents.

I claim:

1. A planar speaker system comprising:

a bottom frame having a cavity, where the bottom frame is substantially circular in shape and has an outer diameter and an inner diameter, and where the cavity of the bottom frame is substantially circular in shape;

a plurality of magnets disposed in the cavity of the bottom frame, the plurality of magnets circumferentially spaced to form a substantially circular pattern. the circular pattern coaxially aligned with a central axis of the planar speaker system, wherein the plurality of magnets are each substantially trapezoidal in shape;

a top frame connected to the bottom frame, where the plurality of magnets are located between the bottom frame and the top frame where the top frame is formed to include a plurality of openings arranged in a substantially circular pattern around a central axis of the top frame;

a diaphragm which is substantially circular in shape and has an outer diameter and an inner diameter, the diaphragm having a plurality of circumferentially spaced electrically conductive traces formed thereon, each conductive trace having a central region without conductive traces, the diaphragm extending across the cavity of the bottom frame;

an annular ring connected to the outer diameter of the bottom frame and the outer diameter of the diaphragm, where the annular ring is located between the outer diameter of the bottom frame and the outer diameter of the diaphragm to couple the outer diameter of the bottom frame to the outer diameter of the diaphragm; and a pole piece connected to the inner diameter of the bottom frame and the inner diameter of the diaphragm.

2. The planar speaker system of claim 1, where the electrically conductive traces are arranged on the diaphragm to cooperatively align with the plurality of magnets arranged to form the substantially circular pattern.

3. The planar speaker system of claim 1, where the plurality of magnets are either ferrite magnets or rare-earth magnets.

4. The planar speaker system of claim 1, where the bottom frame is formed to include a plurality of openings arranged in a substantially circular pattern.

5. The planar speaker system of claim 1, where the top frame is substantially circular in shape and has an outer diameter;

where the diaphragm is substantially circular in shape and has an outer diameter; and where the outer diameter of the diaphragm is connected to the outer diameter of the bottom frame and the outer diameter of the top frame.

6. The planar speaker system of claim 5, wherein the annular ring is connected to the outer diameter of the top frame.

7. A planar speaker system comprising:

a bottom frame having a cavity, wherein the bottom frame is substantially circular in shape and has an outer diameter and an inner diameter, where the cavity of the bottom frame is substantially circular in shape;

a plurality of magnets disposed in the cavity of the bottom frame, the plurality of magnets circumferentially spaced to form a substantially circular pattern;

a diaphragm which is substantially circular in shape and has an outer diameter and an inner diameter, the diaphragm having a plurality of circumferentially spaced electrically conductive traces formed in a substantially circular pattern, each conductive trace defining an area without conductive traces, wherein a border of each magnet is generally aligned with one of the plurality of conductive traces, the outer diameter of the diaphragm being connected to the outer diameter of the bottom frame and extending across the cavity of the bottom frame;

where the diaphragm has an inner diameter an annular ring connected to the outer diameter of the bottom frame and the outer diameter of the diaphragm, where the annular ring is located adjacent to the outer diameter of the bottom frame and the outer diameter of the diaphragm to connect the outer diameter of the bottom frame to the outer diameter of the diaphragm; and a pole piece adjacent to the inner diameter of the bottom frame and the inner diameter of the diaphragm.

8. The planar speaker system of claim 7, further comprising a top frame connected to the bottom frame, where the plurality of magnets are located between the bottom frame and the top frame.

9. The planar speaker system of claim 8, where the top frame has a plurality of openings arranged in a circular pattern around a central axis of the top frame.

10. The planar speaker system of claim 8, where the bottom frame is substantially circular in shape and has an outer diameter;

where the top frame is substantially circular in shape and has an outer diameter;

where the diaphragm is substantially circular in shape and has an outer diameter; and where the outer diameter of the diaphragm is connected to the outer diameter of the bottom frame and the outer diameter of the top frame.

11. A planar speaker system comprising:

a substantially circular bottom frame having a cavity, an outer diameter and an inner diameter, where the cavity of the bottom frame is substantially circular in shape;

a plurality of magnets disposed in the cavity of the bottom frame, the plurality of magnets circumferentially spaced to form a substantially circular pattern;

a substantially circular top frame connected to the bottom frame, where the plurality of magnets are located between the top frame and the bottom frame, where the top frame has a plurality of openings arranged in a circular pattern around a central axis of the top frame;

a diaphragm having a plurality of circumferentially spaced electrically conductive traces formed thereon, each conductive trace defining an open space without conductive traces, wherein a border of each magnet is generally aligned with the open space of one of the plurality of conductive traces, the diaphragm being connected to the outer diameter of the bottom frame and extending across the cavity of the bottom frame;

where the diaphragm has an inner diameter;

a pole piece connected to the inner diameter of the bottom frame and the inner diameter of the diaphragm; and an annular ring connected to the outer diameter of the bottom frame and the outer diameter of the diaphragm, where the annular ring is located between the outer diameter of the bottom frame and the outer diameter of the diaphragm to connect the outer diameter of the bottom frame to the outer diameter of the diaphragm.

* * * * *